US010820676B2

(12) United States Patent
Kock et al.

(10) Patent No.: US 10,820,676 B2
(45) Date of Patent: Nov. 3, 2020

(54) HAIR SHAPING DEVICE

(71) Applicant: WIK Far East Ltd., Hong Kong (CN)

(72) Inventors: Marwin Kock, Essen (DE); Robert Tempel, Moers (DE)

(73) Assignee: WIK FAR EAST LTD., Hong Kong (CN)

( * ) Notice: Subject to any disclaimer, the term of this patent is extended or adjusted under 35 U.S.C. 154(b) by 859 days.

(21) Appl. No.: 15/308,817

(22) PCT Filed: Jun. 3, 2015

(86) PCT No.: PCT/EP2015/062402
§ 371 (c)(1),
(2) Date: Nov. 3, 2016

(87) PCT Pub. No.: WO2015/185641
PCT Pub. Date: Dec. 10, 2015

(65) Prior Publication Data

US 2017/0172273 A1 Jun. 22, 2017

(30) Foreign Application Priority Data

Jun. 6, 2014 (DE) ..... 20 2014 102 652 U

(51) Int. Cl.
*A45D 2/36* (2006.01)
*A45D 6/02* (2006.01)
(Continued)

(52) U.S. Cl.
CPC ..... *A45D 2/367* (2013.01); *A45D 2/001* (2013.01); *A45D 2/02* (2013.01); *A45D 2/10* (2013.01);
(Continued)

(58) Field of Classification Search
CPC ... A45D 2/02; A45D 2/10; A45D 2/00; A45D 2/367; A45D 2/362; A45D 2/36;
(Continued)

(56) References Cited

U.S. PATENT DOCUMENTS

2010/0263684 A1* 10/2010 De Benedictis ..... A45D 2/02 132/272
2015/0128987 A1* 5/2015 De Benedictis ..... A45D 2/02 132/238

FOREIGN PATENT DOCUMENTS

CN 103549750 A 2/2015
WO 2009077747 A2 6/2009
(Continued)

OTHER PUBLICATIONS

International Search Report dated Aug. 28, 2015 in parent case PCT/EP2015/062402.
(Continued)

*Primary Examiner* — Edward Moran
(74) *Attorney, Agent, or Firm* — Polson Intellectual Property Law, PC; Margaret Polson; Christopher Sylvain

(57) ABSTRACT

A hair-shaping device comprising a winding core, a rotatably drivable entraining element with an axis of rotation which corresponds to the longitudinal axis of the winding core, the entraining element designed to grasp a strand of hair and to wind the strand of hair around the winding core, and a housing that encloses the winding core, wherein the radial distance of the inside of the housing from the lateral surface of the winding core in the region of a winding space is sufficiently large such that winding the strand of hair onto the winding core is not hindered. The housing comprises a slot extending in the direction of the longitudinal extent of the winding core. The entraining element is arranged inside the winding space. The slot is designed for inserting a segment of hair to be shaped into the winding space and
(Continued)

extends into the housing part facing the hair pull-in side and bounding the winding space in this direction, such that a strand of hair inserted into the insertion slot is caught by the entraining element rotating inside the winding space. The housing has a warm air flow inlet for supplying heat to a strand of hair located in the winding space between the winding core and the housing.

19 Claims, 8 Drawing Sheets

(51) Int. Cl.

| | |
|---|---|
| ***A45D 20/12*** | (2006.01) |
| ***A45D 2/10*** | (2006.01) |
| ***A45D 2/02*** | (2006.01) |
| ***A45D 2/00*** | (2006.01) |
| ***A45D 6/00*** | (2006.01) |

(52) U.S. Cl.
CPC ..... *A45D 2/36* (2013.01); *A45D 6/00* (2013.01); *A45D 6/02* (2013.01); *A45D 20/12* (2013.01)

(58) Field of Classification Search
CPC ..... A45D 2/001; A45D 2/006; A45D 1/04; A45D 1/20; A45D 6/00; A45D 6/02; A45D 6/04
See application file for complete search history.

(56) References Cited

FOREIGN PATENT DOCUMENTS

| | | |
|---|---|---|
| WO | 2012080751 | 6/2012 |
| WO | 2015064860 A1 | 5/2015 |
| WO | 2016134844 A1 | 9/2016 |

OTHER PUBLICATIONS

Written Opinion of the International Searching Authority dated Aug. 28, 2015 in parent case PCT/EP2015/062402.
Office action dated Mar. 5, 2019 in related Chinese application 1201580030125.1.
Office action dated Aug. 20, 2018 in related European application 15728471.2.

* cited by examiner

HAIR SHAPING DEVICE

This application is a U.S. national stage entry of international application number PCT/EP2015/062402 filed Jun. 3, 2015 which claims priority to German application number DE 20 2014 102 652.5 filed Jun. 6, 2014.

BACKGROUND

The present disclosure relates to a hair shaping device, comprising:

a winding core for winding a strand of hair;

a rotatably drivable entraining element, the axis of rotation of which corresponds at least largely to the longitudinal axis of the winding core, the entraining element being designed to grasp a strand of hair to be wound onto the winding core and to wind this strand around the winding core; and a housing that at least largely encloses the winding core, wherein the radial distance of the inside of the housing from the lateral surface of the winding core in the region of a winding space is selected to be sufficiently large such that the winding of a strand of hair onto the winding core is not hindered, the housing comprising a slot extending in the direction of the longitudinal extent of the winding core for inserting a strand of hair to be shaped.

Similar types of hair shaping devices are used to curl hair. It is perceived to be particularly practical that, by virtue of the driven entraining element, the winding of a strand of hair to be curled onto a winding core takes places automatically. To support the formation of the curl, the strand of hair to be shaped is heated. The goal of supplying heat is not only to expedite the hair shaping process, but also to make the shaped hair last longer. If sufficient heat is supplied, the hydrogen bonds and/or salt bonds present for the stabilization of each hair are broken, and at a higher temperature so are also the disulfide bonds. As the shaped strand of hair cools, these bonds form again, but in the shape that the hair is in.

A hair shaping device is known from EP 2 242 393 B1, for example. In this hair shaping device, the housing wall is heated so as to heat the strand of hair wound onto the winding core. In addition, the winding core may also be heated. As a result of the heated walls, a strand of hair wound onto the winding core is heated by radiant heat. If the winding core is also heated, additional heating of the wound strand of hair takes place by the contact with the winding core. To ensure sufficient heating of a strand of hair, the heated walls must be heated to a relatively high temperature, or must have been heated to such a temperature already before starting the hair shaping process. If the hair comes in contact with the heated surface areas, which is certainly true for a heated winding core, this may cause local overheating of the hair. In devices of this type, in which the hair shaping device forms part of an overall device, shaping of the hair at times does not last very long compared to a configuration in which the hair shaping device is actuated by a drive unit, and the hair shaping device is subsequently separated from the drive unit and remains in the hair until the curl has cooled.

Another hair shaping device is known from WO 2012/080751 A2. This device is designed similarly to the device known from EP 2 242 393 B1 with respect to the heat supplied to a strand of hair wound onto the winding core. However, it is pointed out in one passage that heat may also be supplied by way of a warm air flow.

The hair shaping device described in WO 2012/080751 A2 is a refinement of that known from EP 2 242 393 B1. In contrast to the latter, the hair shaping device known from WO 2012/080751 A2 has a two-tong design. While the housing comprising the winding space and the rotatably driven entraining element is assigned to one tong, the second tong is used to close the insertion slot. In this hair shaping device, the entraining element is designed to grasp the strand of hair so as to pull the same through the insertion slot into the winding space. The second arm closes a V-shaped hair strand clamp during operation of the device, so that no further hairs or strands of hair are pulled into the winding space by the rotating entraining element and wound around the winding core after one strand of hair has been inserted.

In both previously known hair shaping devices, the strand of hair is not inserted into the winding space until the entraining element has grasped the strand of hair, and the strand is then pulled into the winding space as a result of the rotational movement. This concept makes it necessary for these hair shaping devices to have a relatively large design in the radial direction based on the axis of rotation of the entraining element.

The foregoing examples of the related art and limitations therewith are intended to be illustrative and not exclusive. Other limitations of the related art will become apparent to those of skill in the art upon a reading of the specification and a study of the drawings.

SUMMARY OF THE INVENTION

The following embodiments and aspects thereof are described and illustrated in conjunction with systems, tools and methods which are meant to be exemplary and illustrative, not limiting in scope. In various embodiments, one or more of the above described problems have been reduced or eliminated, while other embodiments are directed to other improvements.

Proceeding from the prior art, the present disclosure relates to a hair shaping device for curling a strand of hair of the type mentioned at the outset, which can be designed to be more compact and simplify handling. A hair shaping device according to the present disclosure may not only allow for a strand of hair to be curled to be heated gently, but also for hair curls to be shaped in a relatively long-lasting manner, even without having to hold the actual curler device in the hair over an extended period.

In a hair shaping device according to the present disclosure, the slot for introducing the hair into the winding space is designed in such a way that a strand of hair can be inserted manually into the winding space. Manual insertion of a strand of hair into the winding space is necessary for this strand to be grasped by the entraining element rotating in the winding space. Therefore, the entraining element does not have to be moved out of the winding space to grasp a strand of hair. This may be achieved by an insertion slot that extends into the part of the housing part facing the hair pull-in side and forms the termination of the hair shaping device on the hair pull-in side, and thus, on this side, has a radial extent in relation to the axis of rotation of the entraining element. In contrast, the winding space is closed on the end of the insertion slot located opposite the hair pull-in side, so that, on this side of the hair shaping device, the insertion slot has no or little radial extent in the direction of the axis of the winding core. Typically, the insertion slot is provided at a slight distance from the termination of the housing of the hair shaping device on this side opposite the hair pull-in side. The insertion slot thus extends across two housing sides disposed at an angle to one another. Naturally, the abutting housing sides can also have a curved design. In such a design, the entraining element is disposed adjacent to the housing wall, the outside of which points in the direction of the strand of hair to be pulled in. The winding core is then located between the entraining element and the wall which is located opposite the hair pull-in side and delimits the winding space. A strand of hair inserted through the insertion slot thus protrudes into the winding space of the hair shaping device and is guided between the two opposing ends of the insertion slot or supported at the ends of the insertion slot. In this way, the angled design of the winding space delimitation in the region of the insertion slot relative to a strand of hair inserted therein creates a space in which the entraining element is able to rotate during operation of the hair shaping device without having to be moved out of the winding space. This not only increases the operational safety of such a device, but also allows for a compact and easy-to-handle configuration.

With such an embodiment, which due to the described configuration comprises only one winding core on one side of the entraining element, it is possible to wind even moist hair onto the winding core. In previously-known hair shaping devices of the type in question, it is almost impossible to wind moist hair and in particular when these devices comprise two winding cores, each core being disposed on one side of the entraining element. This is due to the higher friction created by a strand of moist hair, increasing the tension on the hair and making this uncomfortable at times. As a result of the above-described concept, the bending radii that a strand of hair is subjected to by being grasped by the entraining element are much greater, whereby, in turn, the friction acting on the strand of hair is reduced.

In one embodiment, the insertion slot has a hair strand catch on the hair pull-in side end. This catch may be delimited on the inlet-side by at least one flexible element, which is typically an elastic extension protruding into the insertion slot. Embodiments using catch inlet members that are located opposite of one another or that are located opposite of one another at a slight offset are also possible. When a strand of hair is inserted, this strand is guided through the catch inlet member or members and is then located within the hair strand catch. This supports guidance of the strand of hair that is pulled in through the catch when being wound onto the winding core, and as a result, the strand remains together in the form of a wisp of hair. In a simple manner, this effectively counteracts fanning of the strand of hair when pulled in, which could cause a portion of the strand of hair not to be grasped by the entraining element.

The insertion slot may have a width that allows one strand of hair to be pulled in through the same, but preferably not that a human finger could be passed through the insertion slot. Typically, the width of such an insertion slot does not exceed 5 mm.

Moreover, a warm air flow may be used as a heat transfer medium in a hair shaping device according to the present disclosure. This warm air flow is introduced into the housing enclosing the winding space during operation of the device. Such a warm air flow not only has an advantage that the transported heat is supplied directly to the hair to be shaped by virtue of the moved medium, but also dries the hair at the same time. The heat supply effect is more effective in a hair shaping device according to the present disclosure than in previously-known devices, in particular when a strand of wet or moist hair is to be curled. Due to the moved heat transport medium, the heat introduced into the winding space is distributed evenly or at least substantially evenly. It is furthermore advantageous that the supplied heat immediately reaches the hair present in the winding space, and at the intended temperature. To maintain the temperature in the winding space as long as possible, the side of the winding space pointing away from the hair pull-in side may be closed. This also ensures that warm air does not reach the scalp directly, against which the closed outer side of the device may be placed. Another advantage of supplying a warm air flow is the lower amount of heat required, compared to the temperature of radiant heaters, to heat the strand of hair to the desired temperature. This permits the housing to be made of plastic material, whereby the manufacturing costs can be kept low in this regard. If a warm air flow is provided for supplying the heat desired for the shaping process, it is not only possible to rapidly heat the hair, but also to stop the supply of heat equally rapidly by shutting off the warm air flow. Due to, at the most, minor heating from the remaining components of the hair shaping device by way of the warm air flow, a strand of hair wound around the winding core thus cools rapidly, after the warm air flow has been shut off, to a temperature at which the bonds broken by the supply of heat can be formed again in the hair. In this way, without having to tolerate a long wait for cooling, this device allows the curl that has been wound onto the winding core and heated to be removed from the winding core once the curl has cooled sufficiently for the shape to remain stable as a result of the reorientation of the aforementioned bonds in the hair. It is thus not necessary to separate the hair shaping device from an overall device to achieve longer-lasting shaping of the hair. This process can be facilitated by introducing an unheated air flow into the winding space, such as through the warm air flow inlet, subsequent to supplying heat via a warm air flow. In these embodiments, the heating device is simply switched off, while the supply of air continues during operation of the device after sufficient heat has been supplied. Naturally, such a cyclic temperature control of the hair shaping device does not have to be carried out manually, but can be controlled by the device as a temperature control cycle. In this respect, a cooling air flow, which follows a warm air flow and is introduced into the winding space, can be used fix a curl shaped while heat was being supplied in a relatively short time.

In another embodiment, the warm air flow is also coupled into the interior of the winding core. In such a case, the winding core may include perforations to allow the warm air flow to also flow against the hair wound onto the winding core from the inside. In addition or also as alternative, it is possible to heat the winding core using a resistance heater, wherein this advantageously heats the surface of the winding core only so much that damage to the hair is definitely prevented. Such heating of the winding core is used only as an optional addition to a supply of heat, and ultimately the heat transported in the warm air flow corresponds to the degree of heating of the lock of hair wound onto the winding core. For this reason, in such a case, the temperature of the warm air flow is typically higher than that which is used to heat the winding core. Moreover, it is advantageous if the winding core is only heated to such a temperature that none of the above-described bonds present in the hair are broken once this temperature is reached.

The entraining element of the hair shaping device is driven by an electric motor according to one embodiment. Other drive systems, for example utilizing the air flow that is already provided, are also possible. The entraining element may be isolated from rotation with respect to the winding core. In such a case, the winding core will rest relative to the entraining element when the entraining element is prompted to carry out a rotational movement. In certain embodiments, it may also be helpful to rotatably mount the winding core in a manner that is isolated from rotation with respect to the entraining element. To implement this, it is provided in one embodiment to use a sleeve mounted on a shaft to serve as the winding core. If the winding core is rotatably mounted, tensile stresses on the hair to be wound can be reduced, especially in connection with the process of unwinding the shaped curl from the winding core. If such a rotatable mounting of the winding core is provided, the shaft on which the winding core is mounted can be driven in a rotatory manner. The entraining element may then be integrally formed on the shaft. As a result, the two elements can then be produced in one piece, for example from a suitable plastic material. In such an embodiment, a rotational movement of the shaft, together with the entraining element integrally formed thereon, can be used to rotate the winding sleeve via friction when the entraining element is driven, however without using kinematic forced coupling. As soon as the hair comes in contact with the winding core, the winding core, if it rotates as a result of the rotational movement of the shaft, is decelerated so that a movement of the winding core decreases as the winding activity increases. In this way, tensile and frictional loads on the strand of hair to be shaped can be reduced during the winding process, if not entirely avoided.

To support the winding process and to support a distribution of the strand of hair across at least a certain longitudinal extent of the winding core, some embodiments provide a wall which projects from the inside of the housing radially inward in the direction of the winding core, at a small distance from the movement path of the entraining element. The distance between the free end face of this wall and the lateral surface of the winding core is sufficiently large to allow a strand of hair to be wound onto the winding core to be pulled through the remaining hair gap without difficulty. It must be taken into consideration in this connection that the entraining element grasps a strand of hair at a small distance from the surface of the head, and that, during operation of the hair shaping device, the strand of hair is successively wound onto the winding core, and more particularly by this strand of hair being successively pulled toward the end thereof.

Taut winding of the strand of hair around the winding core is generally not intended when using a hair shaping device according to the present disclosure. Rather, it is provided with such a hair shaping device that the strand of hair is wound loosely around the winding core. This has the advantage that only low tensile stress then acts on the hair, despite being wound onto the winding core. This also supports the firmness of a created curl in connection with the cooling process of the curl being held in shape, since the resultant hydrogen bonds, salt bonds and/or disulfide bonds form in keeping with the shape in which the hair is being held. On the other hand, tensile stress acting on the hair, as occurs when the strand of hair is wound too tautly around the winding core, causes the relevant bonds for shaping to also become oriented in keeping with the tensile stress. Therefore, the lasting nature of shaping a curl is supported according to the present disclosure. To prevent winding a strand of hair too loosely around the winding core, wherein winding too loosely means that the diameter of the wound hair section is too large, it is provided in one embodiment to integrally form hold-down devices on the inside of the housing projecting inwardly. These can be provided as walls or ribs projecting from the inside of the housing for example. The space located between such walls or ribs is needed for the distribution of the warm air flow. Instead of walls or ribs, it is also possible for a perforated cage held concentrically or at least largely concentrically to the longitudinal axis of the winding core to serve as a hold-down device.

The entraining element driven in a rotatory manner may have a hook design, wherein the hook opening points in the direction of rotation of the entraining element. If the entraining element can be driven in a rotatory manner in both directions, a Janus face-like double hook can be provided as the entraining element in such an embodiment, the two hook openings being oriented so as to point away from one another and to each point in one direction of rotation. The radial extent of the entraining element extends up to the inner wall of the housing, leaving a small movement gap. The hook end is located in this position. Seen in the circumferential direction, the entraining element preferably extends only across an extent necessary to ensure its function. Due to the necessary radial extent, a strand of hair cannot be inserted into the hair insertion slot when the entraining element is in a position in which it bridges or at least largely bridges the hair insertion slot. If the entraining element extends only across a smaller section in the circumferential direction, for example less than 60°, it will generally not be in a position in which a strand of hair cannot be inserted through the hair insertion slot as intended when the drive is stopped. Such an embodiment thus generally does not require any complex control mechanisms that ensure that the hair insertion slot is clear for the insertion of hair. If the entraining element is coincidentally located in a position that prevents a strand of hair from being inserted, brief actuation of the drive of the entraining element can be used to bring the entraining element out of the blocking position thereof.

In a further embodiment according to the present disclosure, a hair shaping device is provided in which the entraining element has a free run across a certain rotation angle range with respect to a drive element driving the entraining element.

In such a hair shaping device, the entraining element is designed to extend only across a relatively small angular range in the circumferential direction. This allows the strand of hair to be shaped to be inserted into the insertion slot in virtually any arbitrary position of the entraining element. Therefore, the entraining element has a certain free-running region and is not subjected to forced driving within the provided free-running region in at least one direction. If the entraining element is thus located in a position in which the insertion of a strand of hair into the insertion slot is blocked by the entraining element, this entraining element can be readily moved out of the blocking position, together with the strand of hair, due to the free run thereof. Such a solution also generally does not require an electronic controller for positioning the hook opening or the hook openings. The free-running region range typically extends between 90 and 180 degrees with respect to the axis of rotation of the entraining element in such an embodiment. It is advantageous if the entraining element, in a basic position, is held centrally or approximately central with respect to the free run rotation range thereof. The entraining element can then be moved in both directions of rotation for driving purposes without rigid forced coupling. This is possible, for example, through the use of a restoring member (e.g., a spring element) disposed between the entraining element and the drive element driving the entraining element. Such a restoring member is provided with only such a restoring force that the unloaded entraining element is moved back into the intended basic position after the driving process has ended.

The restoring member is moreover sufficiently yielding so that the actual driving force, at least when the entraining element has grasped a strand of hair, in any case is not decisively introduced into the entraining element via the restoring member. This can be implemented by using a driving cam as the driving element, which engages in a free run recess of the entraining element.

In an embodiment of a hair entraining element having a certain free running range, the driving process does not have to be interrupted for inserting a strand of hair into the insertion slot so as to shape the hair, and consequently the electric motor used to drive the entraining element does not have to be shut off. When a strand of hair is inserted into the insertion slot while the entraining element is being driven, the free run of the entraining element limited across an angular range causes this entraining element to be stopped briefly by the strand of hair, which results in a relative movement between the entraining element and the drive element. It is only when the free space in the corresponding direction of rotation has been exhausted that the entraining element is again caused to perform a rotational movement, and the grasped strand of hair is wound around the winding core. Therefore, the entraining element may be provided with a stop surface at the hook end pointing in the direction of rotation, the hair entraining element with the stop surface striking against a strand of hair that is inserted into the insertion slot in the region of the mouth so as to achieve the above-described interruption in the driving process. This is utilized to then insert the strand of hair into the hook opening pointing in the direction of rotation.

The above-described embodiment of a hair shaping device, comprising the entraining element mounted with free run across a certain angular range relative to a drive element, is suitable for all hair shaping devices of the type in question, and can thus also be used for hair shaping devices that cause heat to be supplied to the hair wound onto the winding core in a manner other than by way of a warm air flow.

In another embodiment, the hair shaping device additionally comprises a hair straightening device. For this purpose, this hair shaping device comprises two mutually opposing shaping bodies, which are disposed within the winding space, having a radial extent in the direction of the insertion slot. At the sides pointing toward one another, the shaping bodies each have a shaping surface, at least in sections, which makes contact with a strand of hair that is pulled through the shaping bodies for straightening the hair. Between the two shaping surfaces of the shaping bodies, a strand of hair to be straightened is pulled through the hair shaping gap formed by these while making contact. The contact pressure that is necessary for straightening hair and exerted by the shaping surfaces onto the strand of hair to be straightened can be provided, for example, in that at least one of the shaping bodies is preloaded, such as by one or more springs. Both shaping bodies may be mounted in or on the housing of the hair shaping device in this manner. In the radial distance, sufficient distance remains between the shaping bodies and the winding core such that the shaping bodies do not hinder the winding process. The shaping bodies extend in the radial direction preferably into the insertion slot, or even slightly beyond it. Moreover, the bodies may comprise guide surfaces that are integrally formed on the shaping surfaces and implemented at an angle with respect to the shaping surfaces, and more particularly such that the gap located between the shaping bodies increases proceeding from the shaping surfaces. In this respect, the guide surfaces are used to feed a strand of hair into the hair shaping gap present between the shaping surfaces. If so desired, at least one of the two shaping bodies may additionally be heated.

The hair shaping device will typically be used either for curling or for straightening. During operation of the hair shaping device for curling hair, the distance between the shaping bodies will be increased, so that a strand of hair pulled through these is not shaped on the shaping bodies or the shaping surfaces thereof. For this purpose, an adjusting and locking mechanism is typically provided, which is used to move the shaping bodies away from one another and fix these in the non-usage position. Conversely, during operation of the hair shaping device for straightening hair, the entraining element will be left deactivated and beforehand be moved into a position in which the entraining element is not located in the insertion slot. During such an operation of the hair shaping device, the shaping bodies are in the usage positions thereof, so that a strand of hair pulled through these is straightened.

In further embodiments, a hair shaping device according to the present disclosure can be designed in the form of what is known as an attachment for a device providing a warm air flow. These devices providing a warm air flow can be an air curler or a hair dryer, for example. Air curlers may be preferable due to the shaft-like design thereof, whereby handling of the hair shaping device is simplified. The hair shaping device can likewise form part of an overall device that comprises the hair shaping device and a device supplying a warm air flow. This is then typically accommodated in the handle of such a device.

Moreover, it may be provided in the above-described hair shaping devices that the entraining element forms part of the winding core. Such a component may be a plastic component. In one such embodiment, the electric motor for driving the winding core is located within the housing on the side facing the head. In such an embodiment, it may be provided to design the housing to be openable in the region of the winding core and of the entraining element so as to be able to replace the winding core, together with the entraining element integrally formed thereon. In this way, the winding core can be detachably engaged with the drive shaft of the drive motor in a torque-locked manner. This permits for a winding core having a larger diameter or a smaller diameter to be used, depending on the hair shaping result to be achieved and the size of the curl to be created. For the torque-locked connection of such a detachable winding core to the drive shaft, for example, teeth of the winding core designed as a sleeve and extending circumferentially on the end side may be used which engage in complementary teeth of the drive shaft when the winding core and drive shaft are connected. A rotary detent mechanism or a magnetic coupling can be used to fix the winding core, for example.

In addition to the exemplary aspects and embodiments described above, further aspects and embodiments will become apparent by reference to the accompanying drawings forming a part of this specification.

BRIEF DESCRIPTION OF THE DRAWINGS

The present disclosure is described hereafter based on exemplary embodiments with reference to the accompanying figures. In the drawings.

Before further explaining embodiments of the present disclosure, it is to be understood that the invention is not limited in its application to the details of the particular arrangements shown, since the invention is capable of other embodiments. While exemplary embodiments are illustrated in reference to the figures, it is intended that the embodiments and figures disclosed herein are to be considered illustrative rather than limiting. Also, the terminology used herein is for the purpose of description and not of limitation.

DETAILED DESCRIPTION

Figure 1:
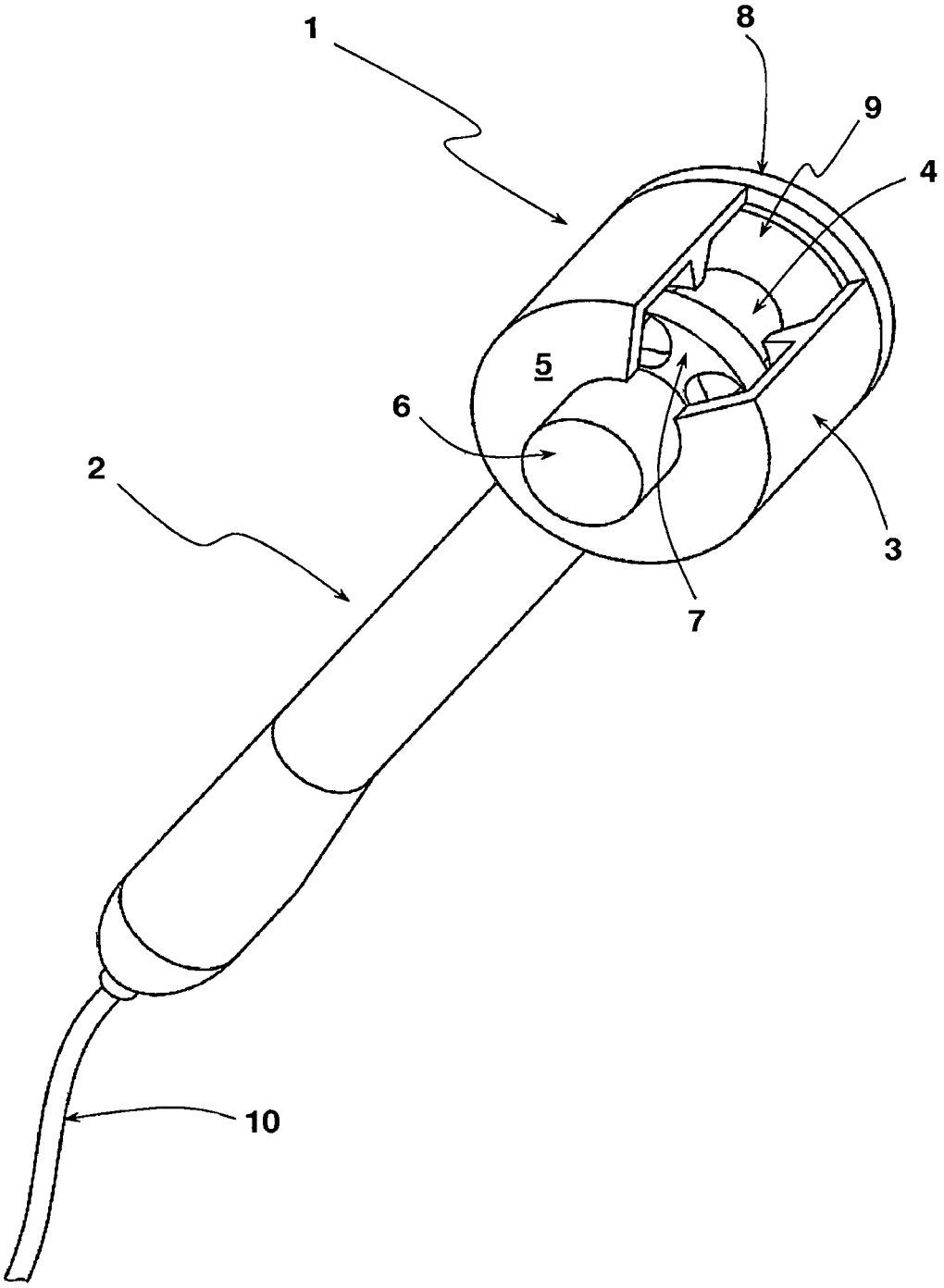
FIG. 1 shows a perspective schematic view of a hair shaping device comprising an air curler disposed thereon in the form of a handle.

FIG. 1 shows a hair shaping device 1, which is connected to an air curler 2. In this embodiment, the hair shaping device 1 and the air curler form one overall device. The hair shaping device 1 can, of course, likewise be attached to an air curler as an attachment, if designed appropriately.

The hair shaping device 1 is used to curl hair. The hair shaping device 1 comprises a winding core 4 located in a housing 3. The housing 3 has a ring cylinder-shaped design in the main section thereof. In this embodiment, both the winding core 4 and the housing 3 are made of a suitable plastic material. A front closing panel 5, which largely closes the space enclosed by the housing at one end, forms part of the housing 3. The closing panel 5 comprises a motor housing 6 with an electric motor disposed therein. The electric motor drives an entraining element 7 in a rotatory manner. The rotational movement of the entraining element 7 is isolated from rotation with respect to the winding core 4. The winding core 4, in turn, is integrally formed on a rear cover 8, which closes the side of the housing 3 located opposite the closing panel 5. The back of the rear cover 8 (not shown FIG. 1) is configured for placement against the head of a person using the hair shaping device 1. Accordingly, the back may be provided with padding.

Figure 4:
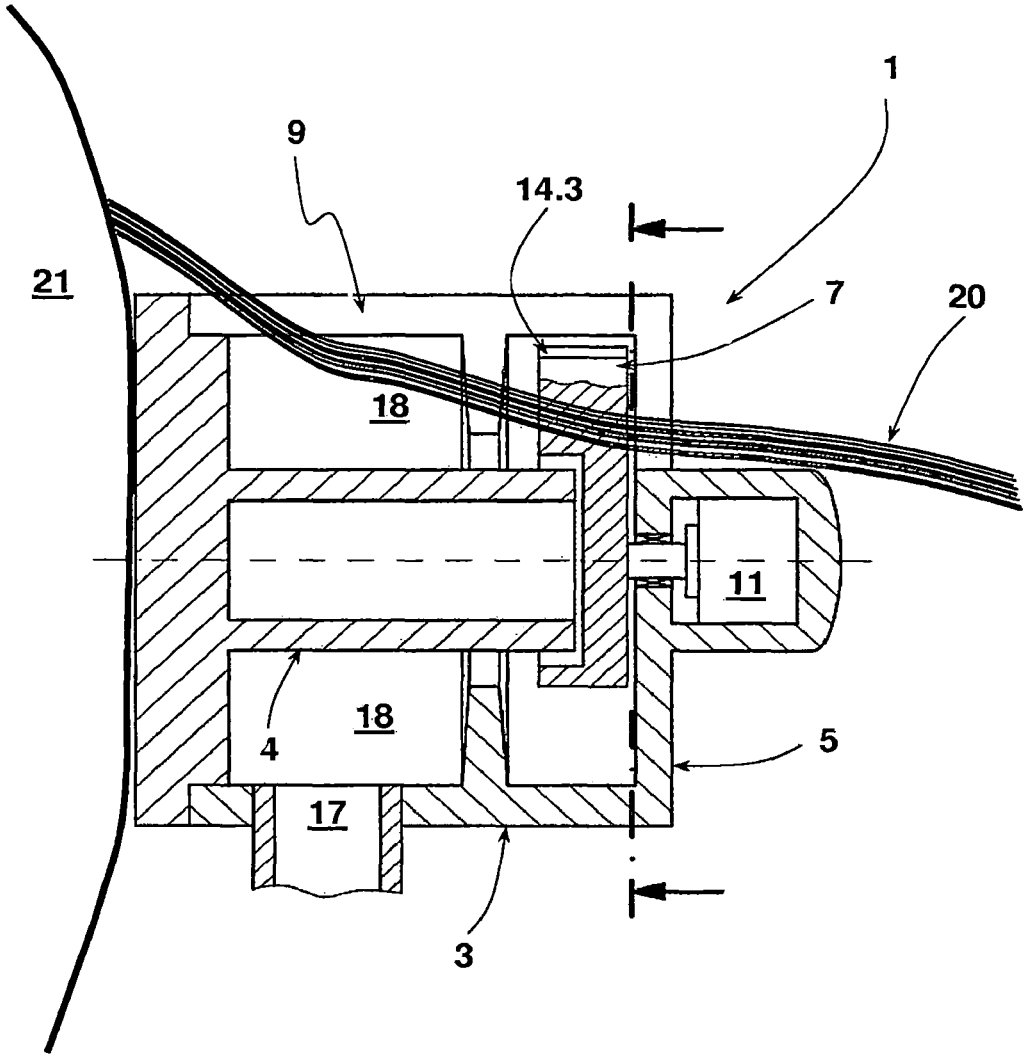
FIG. 4 shows an illustration corresponding to that of FIG. 2, including a strand of hair that is to be shaped and inserted into the hair shaping device.

An insertion slot 9 following the longitudinal extent of the winding core 4 is introduced into the housing 3. This slot is used to insert a strand of hair to be shaped by the hair shaping device 1. The insertion slot 9 is sufficiently wide to be able to accommodate a strand of hair therein. For insertion of a strand of hair, the entraining element 7 is in a position so as not to obstruct the insertion slot 9. In FIG. 1, the entraining element blocks the insertion of a strand of hair into the insertion slot 9 in the shown position. The insertion slot 9 is closed by the rear cover 8. Proceeding from the end on this side, the insertion slot 9 initially extends in the longitudinal extent of the winding core 4 and continues into the closing panel 5 disposed at an angle relative to the cylindrical housing 3. The insertion slot 9 thus has a radial extent in the region of the closing panel 5. In the shown embodiment, the insertion slot 9 extends to the lateral surface of the motor housing 6. The design of the insertion slot 9 on its end toward the head of a person using the hair shaping device 1 provides a hair strand support. The hair strand support has a larger radial distance from the winding axis than on the hair pull-in side, so that a strand of hair inserted into the insertion slot 9 extends with a section directly into the winding space enclosed by the housing 3. Such a strand of hair 20 inserted into the insertion slot 9 is shown in FIG. 4. The strand of hair 20 thus extends largely between the two ends of the insertion slot 9. Due to the angled arrangement of the closing panel 5 pointing to the hair pull-in side and the ring cylindrical portion of the housing 3, and the arrangement of the entraining element 7 adjacent to the closing panel 5, space gained by the angled arrangement is used for the arrangement of the entraining element 7, which is then entirely located in the winding space 18 enclosed by the housing 3. Without having to take additional measures, it is thus possible with this hair shaping device 1 to effectively insert a first section of a strand of hair 20 into the winding space 18, and more particularly such that this strand can be grasped by the entraining element 7. For this reason, the slot introduced into the housing 3 is also referred to as an insertion slot with respect to the subject matter of this hair shaping device 1.

In the depicted embodiment, the insertion slot 9 is illustrated larger than it actually is for the purpose of providing a look into the housing 3. The insertion slot 9 in fact may have a width of no more than 5 mm.

In the shown embodiment, the air curler 2 is used at the same time as a handle for handling the overall device, the device comprising both the hair shaping device 1 and the air curler 2. This air curler thus has a shaft-like design. The illustration of the air curler 2 is simplified in terms of the design thereof. The necessary sensors, such as probes, switches and the like, are not shown. The air curler 2 also comprises a switching device for switching the electric motor present in the motor housing 6 of the hair shaping device 1, and more particularly such a switching device that allows the motor to be operated in both directions of rotation. A warm air fan forms part of the air curler 2, for providing a warm air flow that is introduced into the interior of the housing 3. For operating the hair shaping device 1, the warm air flow is heated to at least such a temperature that the salt bonds in the hair of the strand to the shaped are broken. It is also possible to operate the air curler 2 with a warm air flow having a higher temperature at which disulfide bonds in the hair are also broken. The temperature of the warm air flow can be set in the shown embodiment depending on the type of hair to be shaped. The shown embodiment is supplied with AC line current via supply cable 10 in FIG. 1.

Figure 2:
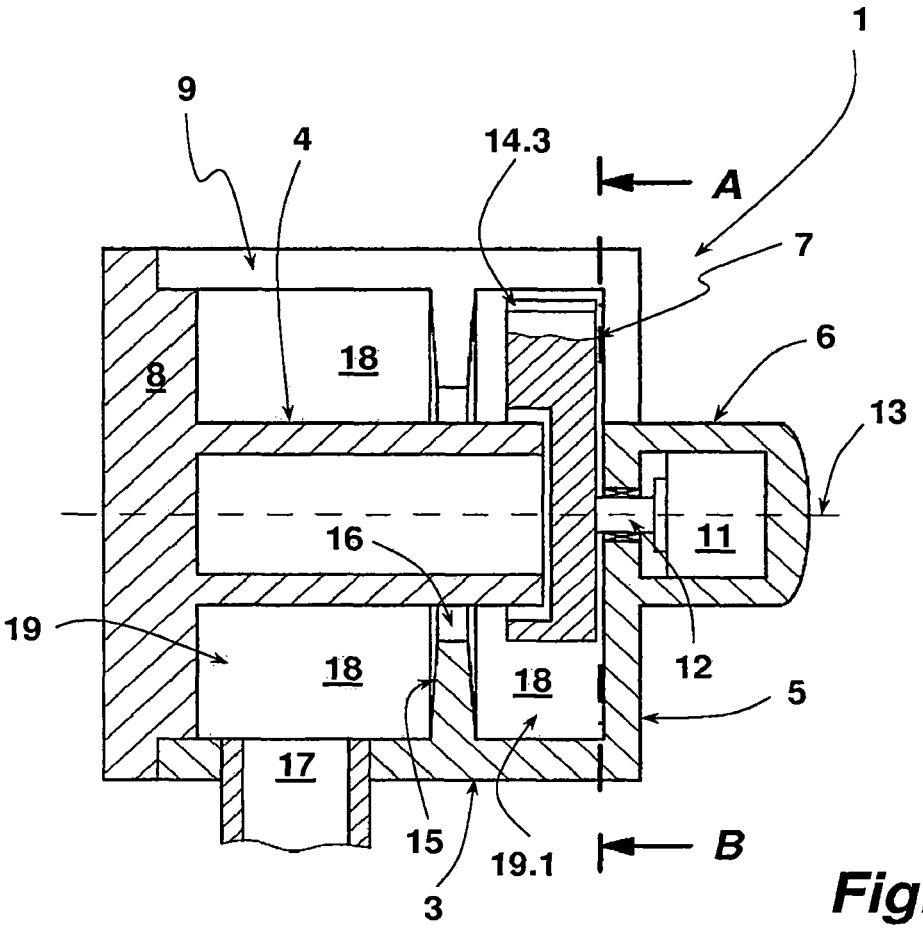
FIG. 2 shows a cross-sectional illustration through the hair shaping device from FIG. 1 without a connected air curler.

The composition of the hair shaping device 2 is apparent in detail from the sectional illustration of FIG. 2. The electric motor located in the motor housing 6 is identified by reference numeral 11 in FIG. 2. For the sake of simplicity, the electrical wiring thereof is not shown. The entraining element 7 is seated on the shaft 12 of the electric motor 11, the axis of rotation 13 of the entraining element being indicated by dash-dotted lines.

Figure 3:
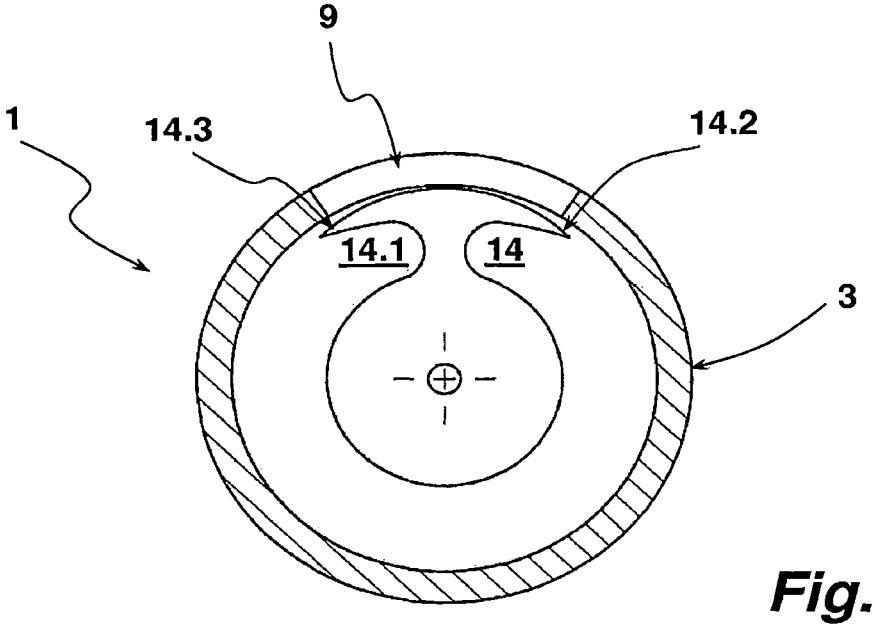
FIG. 3 shows a sectional view along plane A-B through the hair shaping device from FIG. 2.

The entraining element 7 is shown in a side view in the sectional illustration of FIG. 3. The entraining element 7 in this embodiment has a double hook-shaped design and thus comprises two hooks 14.2, 14.3 pointing away from one another in terms of the openings 14 and 14.1 thereof. The entraining element 7 can thus be operated clockwise or counterclockwise to grasp hair to be shaped. The extent of the entraining element 7, seen in the circumferential direction, should be implemented as short as possible. In the shown embodiment, the extent of the entraining element 7 seen in the circumferential direction is slightly larger than 60 degrees, being approximately 75 degrees. Of course, the shorter the circumferential extent of the entraining element 7, the smaller the chance that the entraining element remains in a position that blocks the insertion slot 9 when the electric motor 11 is shut off. The entraining element 7 is shown in such a position in the figures. In general, however, the entraining element will not stop in this position when the electric motor 11 is stopped. In the embodiment of an entraining element comprising only one hook, the extent in the circumferential direction is accordingly lower.

The entraining element 7 is isolated from rotation with respect to the winding core 4. The winding core 4 serves as the core for winding a strand of hair to be shaped. In the shown embodiment, a wall 15 projecting in the direction of the winding core 4 is integrally formed on the inside of the cylindrical section of the housing 3 (see FIG. 2). The distance between the end face 16 of the wall 15 and the lateral surface of the winding core 4 is sufficiently large to allow a strand of hair to be pulled through the remaining gap without difficulty.

The housing 3 of the hair shaping device 1 comprises a warm air flow inlet 17, via which the warm air flow generated in the air curler 2 is introduced into the housing 3 of the hair shaping device 1. The warm air flow inlet 17 is shown only schematically in the figures. Of course, this warm air flow inlet may also extend across largely the entire longitudinal extent of the housing 3. The longitudinal extent of the warm air flow inlet 17 corresponds to the longitudinal extent of the air curler 2 connected to the hair shaping device 1. The axis of rotation 13 of the entraining element 7 and the longitudinal axis of the winding core 4 thus run transversely to the longitudinal extent of the air curler 2 serving as a handle.

In the embodiment of FIG. 2, the warm air flow inlet 17 opens into the housing 3 opposite the insertion slot 9. This may be advantageous for distributing the warm air that is coupled into the housing 3. The warm air flow inlet 17 can, of course, also be disposed in another location. It is also possible to provide multiple warm air flow inlets, which are disposed at a certain angular distance from one another with respect to the longitudinal axis of the winding core.

The space present between the housing 3 and the winding core 4 is referred to as the winding space 18 herein. The winding space 18 is divided into two chambers 19, 19.1 by the wall 15. The section of the winding core 4, around which a strand of hair is wound during operation of the hair shaping device 1, is located in the chamber 19. The entraining element 7 is located in the chamber 19.1. This chamber 19.1 can also be referred to as the entraining element chamber. In this embodiment, the warm air flow inlet opens into the chamber 19. The end face 16 of the wall 15 forms an annular gap with the lateral surface of the winding core 4. Air flows through this gap during operation of the warm air fan. This annular gap is furthermore used to pull in a strand of hair to be wound around the winding core 4. When a warm air flow is supplied to the chamber 19, a strand of hair to be pulled into this chamber is preheated by a warm air flow flowing in a directed manner through the aforementioned annular gap, before the strand of hair is wound onto the winding core 4. As a result, this annular gap between the two chambers 19, 19.1 is also used to generate an airflow pathway preheating of a strand of hair to be wound.

In the shown embodiment, the entraining element 7 has a much wider design than has been known from entraining elements according to the prior art. This is provided to increase bending radii acting on a strand of hair to be wound, which at the same time constitutes strain relief. The width of such an entraining element, for example the entraining element 7, transversely to the direction of rotation thereof is preferably more than 8 mm (e.g., 10 to 15 mm).

After a strand of hair is inserted into the insertion slot 9, as shown in FIG. 4, the entraining element 7 is driven in a rotatory manner by the electric motor 11 to wind the strand of hair 20 onto the winding core 4 during operation of the hair shaping device 1. In FIG. 4, the hair shaping device 1 is positioned with the outside of the cover 8 thereof seated against the head 21 of a person whose strand of hair 20 is to be curled. When the entraining element 7 is driven in a rotatory manner, the strand of hair 20 is successively pulled into the housing 3 until the entire strand of hair has been wound onto the winding core 4. The strand of hair 20 is pulled in toward the free end thereof across the extent of the insertion slot 9 and into the closing panel 5 (see FIG. 4). During the winding process, the air curler 2 may provide a warm air flow into the winding space 18 via the warm air flow inlet 17. This flow is distributed within the winding space 18 and thus directly transports heat present in the warm air flow to hair present in the winding space 18. The radial extent of the winding space 18 is dimensioned such that a strand of hair 20 to be wound therein does not fill this space, but rather that sufficient space remains for the warm air flow to be distributed. The temperature of the warm air flow is sufficiently high to at least break the salt bonds in the hairs of the strand of hair 20 wound around the winding core 4. Once the winding process has ended, the supply of the warm air flow is maintained for a short time to ensure that also the last sections of the strand of hair 20 wound around the winding core 4 are sufficiently heated. Afterwards, the warm air flow supply is ended, so that the strand of hair 20 wound around the winding core 4 can cool, preferably to a temperature at which the bonds that were previously broken by the supply of heat have formed again. In this way, a particularly long-lasting nature of the shaped strand of hair 20 is achieved. The cooling process may also be accomplished by only shutting of the heat supply of the air flow and by cooling the hair present in the winding space 18 by way of an air flow present at ambient air. As a result, the temperature supplied to the hair can be subjected to rapid changes, in contrast to the previously known devices. The curled strand of hair is removed from the hair shaping device 1 by pulling it out of the hair insertion slot 9 again. For this purpose, the hair shaping device 1 will typically be moved away from the head 21. Since the above-described handling has cooled the strand of hair 20 present in the winding space 18 to a temperature at which the bonds that were previously broken in the hair of the strand of hair 20 have formed again, pulling the shaped strand of hair out of the winding space 18 does not change the previously shaped hair structure, at least not to a noteworthy degree. The shaping of the hair that was performed is consequently preserved.

Figure 5:
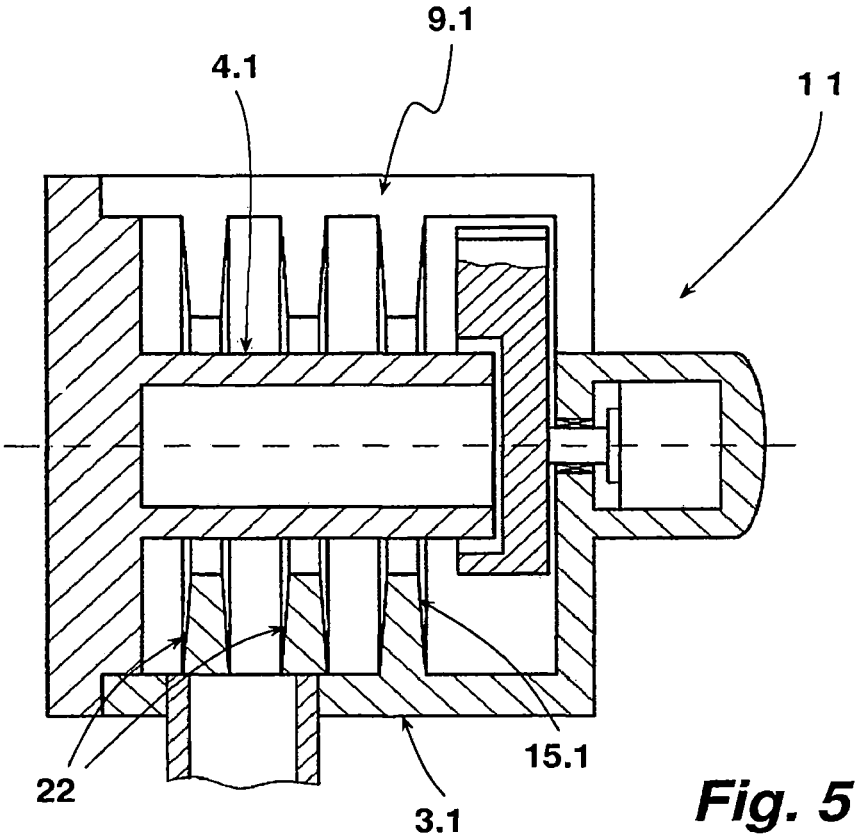
FIG. 5 shows a hair shaping device designed for connection to an air curler.

FIG. 5 shows a hair shaping device 1.1, which has the same design as the hair shaping device 1 of FIGS. 1 to 4 with respect to the above-described features. Those comments thus apply equally to the hair shaping device 1.1. The hair shaping device 1.1 differs from the hair shaping device 1 in that two hold-down walls 22 are provided on the inside, pointing away from the housing 3.1 in the direction of the winding core 4.1. The hold-down walls 22 are designed in the same manner as the wall 15.1 and likewise extend peripherally along the inside of the cylindrical part of the housing 3.1, wherein the insertion slot 9.1 is kept clear. The hold-down walls 22 are used to hold the strand of hair wound onto the winding core 4.1 at the desired radius. A strand of hair wound around the winding core 4.1 is not wound around the winding core 4.1 with the use of tensile stress. The hold-down walls 22 are thus used to hold the desired radius for the intended hair curl.

Figure 6:
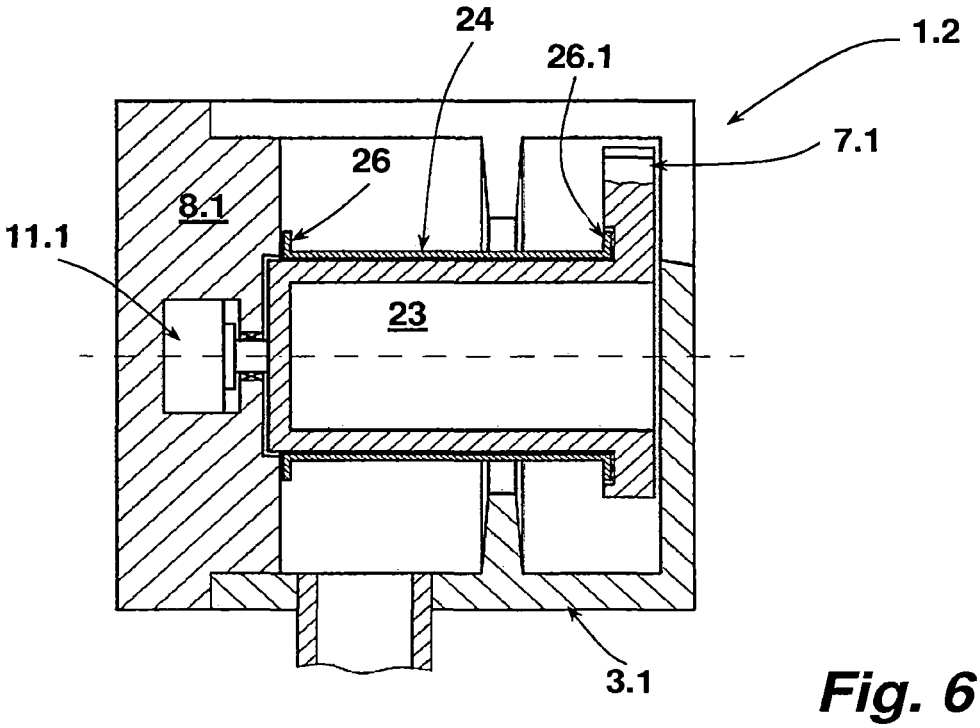
FIG. 6 shows a schematic cross-section through another embodiment of a hair shaping device.

FIG. 6 shows a further embodiment of a hair shaping device 1.2, which likewise has a composition as the above-described hair shaping devices 1, 1.1 in terms of the principles already discussed. In the hair shaping device 1.2, the electric motor 11.1 is located in the rear cover 8.1. A shaft 23 is connected to the shaft 12.1 of the electric motor 11.1, the entraining element 7.1 being integrally formed on the end of the shaft located opposite shaft 12.1. The shaft 23 and the entraining element 7.1 are produced in one piece from a suitable plastic material in this embodiment. A sleeve 24, which is mounted on the shaft 23 isolated from rotation, serves as the winding core in the hair shaping device 1.2. The sleeve 24 extends between the inside 25 of the cover 8.1 and the entraining element 7.1. The effective width of the sleeve 24 is limited by a delimiting flange 26, 26.1 as part of the sleeve 24.

In another embodiment of the hair shaping devices 1 or 1.1, not shown in the figures, it is provided that likewise a sleeve is mounted isolated from rotation on the shaft described thereon as the winding core, as with the hair shaping device 1.2. The sleeve then serves as the winding core. The isolation from rotation of the winding core with respect to a bearing has an advantage that tensile stresses on the hair are largely avoided.

Figure 7:
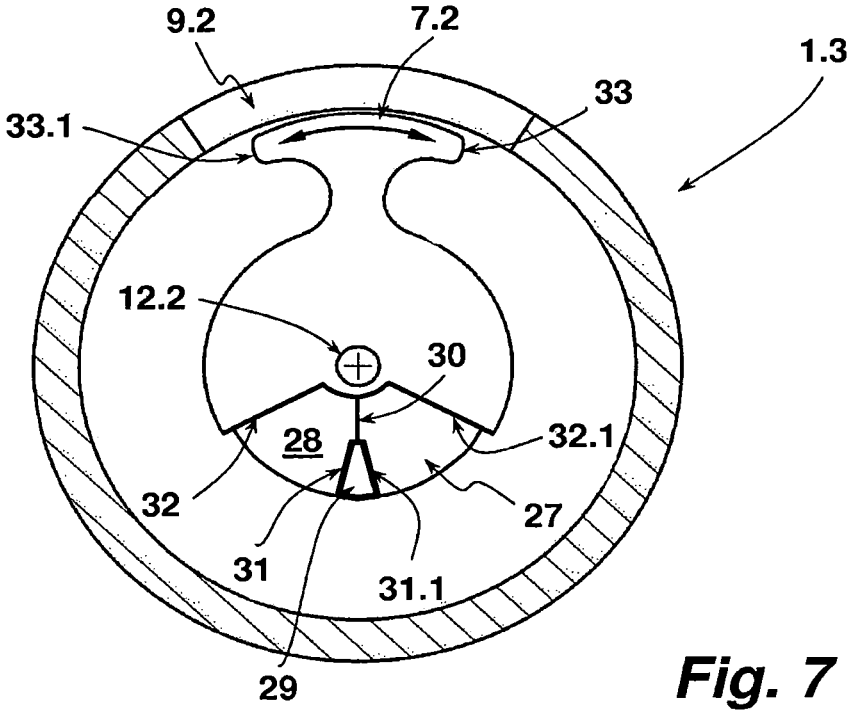
FIG. 7 shows a schematic sectional illustration corresponding to that of FIG. 3 through a further hair shaping device in a first position.

FIG. 7 shows a further hair shaping device 1.3, which, in principle, is designed in the same manner as the hair shaping device 1. The hair shaping device 1.3 differs as to the drive of the entraining element 7.2. While in the embodiment of the hair shaping device 1 the entraining element 7 is rigidly connected to the shaft 12 of the electric motor 11, in the hair shaping device 1.3 the entraining element 7.2 is kinematically connected to the rotational movement of the shaft of the electric motor, providing a certain free run. For this purpose, the entraining element 7.2 comprises a clearance 27, serving as the free run recess, on the side located opposite the hook openings. In the shown embodiment, this extends across approximately 125 degrees. The entraining element 7.2 is mounted isolated from rotation on the shaft 12.2 of the electric motor. A driving disk 28, which carries a driving cam 29 as the driving element, is connected to the shaft 12.2 in a torque-locked manner. The driving cam 29 projects into the clearance 27 of the entraining element 7.2, which is mounted isolated from rotation with respect to the shaft 12.2. A restoring member 30 is disposed between the driving cam 29 and the entraining element 7.2, which in the shown embodiment is implemented by a leaf spring. The restoring member 30 ensures that the unloaded entraining element 7.2 is in the position shown in FIG. 7 with respect to the driving disk 28 together with the driving cam 29 thereof. This cam is located in the clearance 27 relative to the circumferential extent. Without forced driving, the entraining element 7.2 can thus be moved relative to the driving cam 29, as indicated by the double arrow in the head of the entraining element 7.2. The energy stored in the restoring member 30 by such a movement brings the entraining element into the position shown in FIG. 7 with respect to the driving cam 29. This occurs, of course, regardless of the position in which the driving cam 29 is in relation to the direction of rotation thereof.

The restoring member 30, which is a leaf spring here, is sufficiently rigid for the entraining element 7.2 to move rotationally when the driving disk 28, together with the driving cam 29 thereof, is being driven, without one of the two driving surfaces 31 or 31.1 of the driving cam 29 becoming seated against the complementary stop surfaces 32, 32.1, which in turn frame the clearance 27 in the direction of rotation of the entraining element 7.2. The above applies as long as no force that is directed against the rotational movement acts on the entraining element 7.2. On the other hand, the restoring member 30 is sufficiently soft or elastically deformable for the driving cam 29, depending on the direction of rotation thereof, to become seated either with the driving surface 31 thereof against the stop surface 32, or with the driving surface 31.1 thereof against the stop surface 32.1, already at a low rotation-inhibiting force acting on the entraining element 7.2. Forced driving is then present in the particular direction of rotation. The restoring member 30 is designed to ensure that a forced driving arrangement is present between the driving cam 29 and the stop surfaces 32 or 32.1 of the entraining element when the entraining element 7.2 has grasped a strand of hair to be shaped in one of the two hook openings. As a result, the above-described driving situation materializes at a relatively low counter-force.

Figure 8:
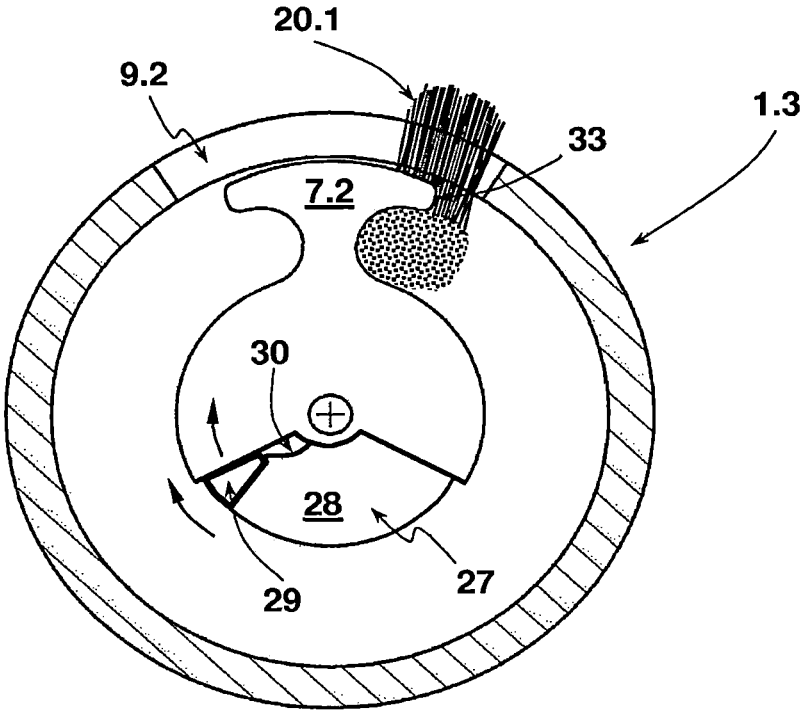
FIG. 8 shows the hair shaping device from FIG. 7 in a driving arrangement for driving the entraining element after grasping a strand of hair.

FIG. 8, by way of example, shows the one forced driving situation of the entraining element 7.2 after grasping a strand of hair 20.1, which is introduced in the hook direction pointing in the direction of rotation. The strand of hair 20.1 passes through the insertion slot 9.2 of the hair shaping device 1.3. Due to forced driving in this direction of rotation, the strand of hair 20.1 is then wound around the winding core of this hair shaping device 1.3. The entraining element 7.2 is driven in that the driving surface 31 of the driving cam 29 acts against the stop surface 32 of the entraining element 7.2 and thus no free-running region range is available any longer in this direction.

In this embodiment, the grasping of the strand of hair 20.1 took place while the entraining element 7.2 was rotating. When the entraining element 7.2 is rotating and no load is acting thereon, the driving cam 29 is approximately in the position shown in FIG. 7 with respect to the clearance 27, possibly slightly offset in the direction of rotation relative to the stop surface 32 of the entraining element 7.2 pointing to the driving cam 29. The remaining free run between the stop surface 31 of the driving cam 29 and the stop surface 32 of the entraining element 7.2 is the free run utilized to grasp a strand of hair that has been inserted into the insertion slot 9.2. Due to the isolation from rotation of the entraining element 7.2 with respect to the driving disk 28, together with the driving cam 29 thereof, the rotational movement of the entraining element 7.2 is delayed when resistance is detected, which is to say when impinging on a strand of hair or grasping the same, and more particularly until the driving surface 31 becomes seated against the stop surface 32. This delay of the hair entraining element 7.2 is sufficient to insert the strand of hair 20.1 into the hook opening pointing in the direction of rotation. To achieve the driving delay of the entraining element 7.2, the hook head has a hammer-like design and has a respective stop surface 33, 33.1 at each of the two sides pointing in the direction of rotation. In FIG. 8, the strand of hair 20.1 has already been introduced into the hook opening pointing in the direction of rotation. As a result, the entraining element 7.2 is stopped when the stop surface 33 acts against the strand of hair 20.1.

Thereafter, free running is no longer required. Rather, the driving cam 29 then acts against the stop surface 32 of the entraining element 7.2 so as to wind the strand of hair 20.1 around the winding core. The displacement of the leaf spring 30, serving as the restoring member, brought about during this course is shown schematically in FIG. 8.

When the strand of hair 20.1 has been wound around the winding core, no force acting against a rotation which is greater than the restoring force of the restoring member 30 acts on the entraining element 7.2, so that the entraining element 7.2 is then moved back into the position shown in FIG. 7, with respect to the arrangement of the driving cam 29 within the clearance 27.

Figure 9A:
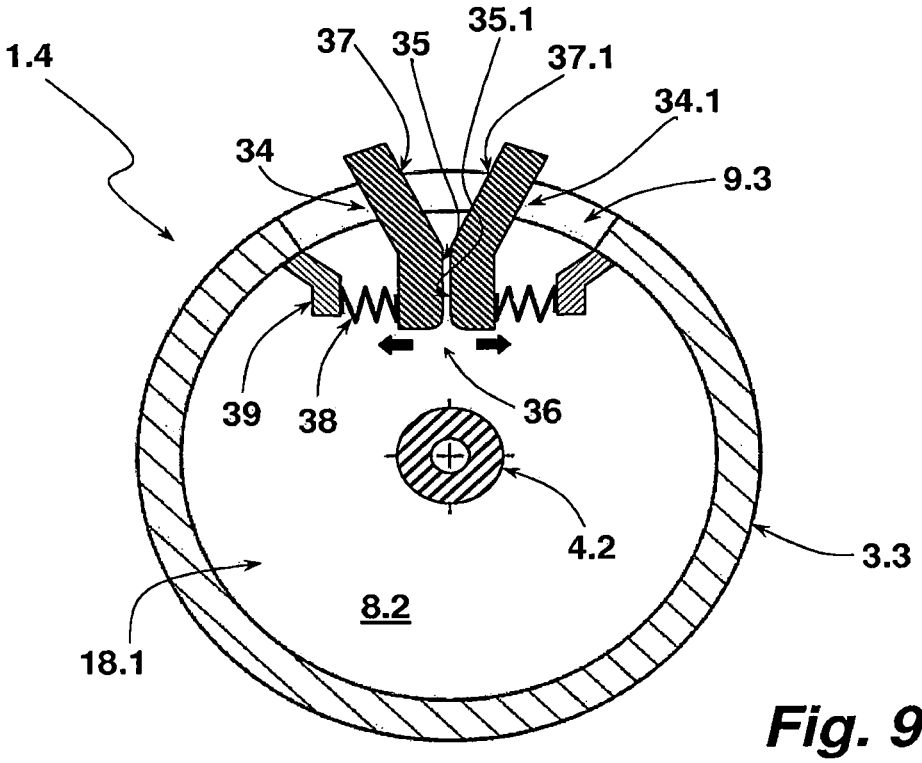
FIGS. 9*a*, 9*b* show schematic cross-sections through a further hair shaping device in a closed and open arrangement, respectively.

FIG. 9*a* shows a cross-section of a further hair shaping device 1.4, which, in principle, is designed in the same manner as the hair shaping device 1. The comments made on the operating principle of the hair shaping device 1 thus apply equally to the hair shaping device 1.4. FIG. 9*a* shows a cross-section through the housing 3.3 of the hair shaping device 1.4, approximately through the center with respect to the longitudinal extent of the winding core 4.2, with a viewing direction toward the rear closing cover 8.2. As with the sectional illustration of FIG. 3, the warm air flow inlet is not shown in the sectional illustration of FIG. 9*a* (the same applies to FIG. 9*b*).

The hair shaping device 1.4 comprises one additional functionality compared to the hair shaping device 1. This additional functionality relates to a straightening functionality. For this purpose, the hair shaping device 1.4 comprises two shaping bodies 34, 34.1. The shaping bodies 34, 34.1 each carry a shaping surface 35, 35.1. The two shaping surfaces 35, 35.1 are disposed opposite one another with respect to a hair shaping gap 36 located between the shaping surfaces 35, 35.1. In addition to the shaping surfaces 35, 35.1, the shaping bodies 34, 34.1 each have a guide surface 37, 37.1. The guide surfaces 37, 37.1 are each angled relative to the abutting shaping surfaces 35, 35.1 and are used to simplify the insertion of a strand of hair into the hair shaping gap 36. In the depicted embodiment, the shaping bodies 34, 34.1 not only have the same design and are disposed mirror-symmetrically with respect to one another, but are also mounted in the housing 3.3 in the same manner. The mounting of the shaping body 34 is described hereafter. The same applies to the shaping body 34.1.

As is indicated by the block arrow in FIG. 9*a*, the shaping body 34 is held in a translatory manner in a guide, which is not shown in figure, and displaceably mounted. On the side pointing away from the hair shaping gap 36, the shaping body 34 is supported against a compression spring 38. An abutment protrusion 39 is integrally formed on the inside of the housing 3.3 and serves as the abutment for the compression spring 38. In this way, the shaping body 34 can be moved in the above-described direction against the restoring force of the compression spring 38. The purpose of this mounting of the shaping body 34 and the corresponding mounting of the shaping body 34.1 is that the shaping surfaces 35, 35.1 of the shaping bodies 34, 34.1 act on a strand of hair introduced into the hair shaping gap 36 with a certain contact pressure. This facilitates the straightening process. The temperature required for straightening is provided in the winding space 18.1 via the warm air flow inlet, which is not shown in the figure. If desired, at least one of the two shaping bodies 34, 34.1 may additionally be equipped with a heating element.

The hair shaping device 1.4 is operated either in a mode for straightening hair or in a mode for creating curls. FIG. 9*a* shows the shaping bodies 34, 34.1 of the hair shaping device 1.4 in the "straightening" functionality. When the hair shaping device 1.4 is used in this functionality, the entraining element is not being driven. As was described for the hair shaping device 1, a strand of hair is inserted into the insertion slot 9.3 of the housing 3.3 in the same manner for straightening and is pulled into the hair shaping gap 36. By pulling the strand of hair through the hair shaping gap 36, the entire strand of hair is successively straightened by the shaping surfaces 35, 35.1 of the shaping bodies 34, 34.1 acting with a certain contact pressure on the strand of hair.

Figure 9B:
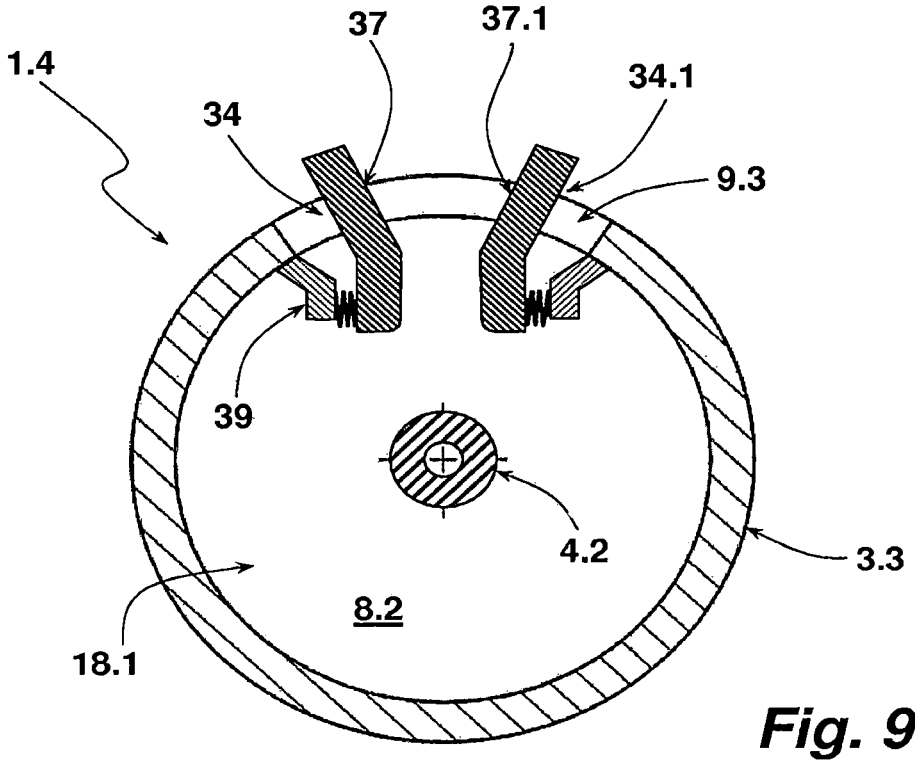

If the hair shaping device 1.4 is intended to be operated for curling a strand of hair, the shaping bodies 34, 34.1 are moved away from one another and brought into the non-usage positions by way of a control device (not shown in the figure) as is illustrated in FIG. 9*b*. In this position, the shaping bodies 34, 34.1 are fixed. In the curling function of the hair shaping device 1.4, the guide surfaces 37, 37.1 support the insertion of a strand of hair into the insertion slot 9.3.

Figure 10:
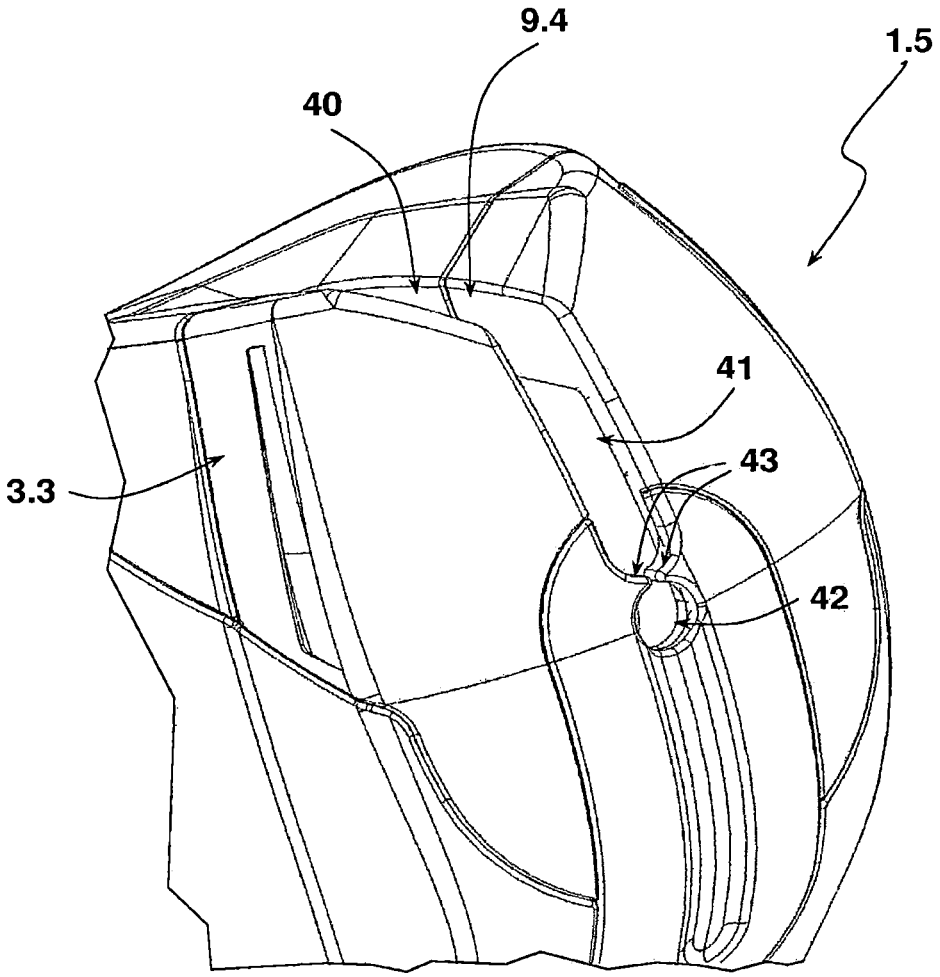
FIG. 10 shows a perspective partial view of still another hair shaping device.

FIG. 10 shows a partial illustration of a further hair shaping device 1.5, which, in principle, is designed in the same manner as the above-described hair shaping devices, and in particular the hair shaping device 1. As with the other above-described hair shaping devices, the insertion slot 9.4 in this hair shaping device 1.5 also has an angled design and comprises a first section 40, which extends parallel to the winding core, and a second section 41, which has a radial extent. The first section 40 is recessed in relation to the termination of the housing 3.3 of the hair shaping device on this side. The inclined surfaces of the housing 3.3 relative to this section 40 are used to simplify feeding a strand of hair. The radially extending section 41 of the insertion slot 9.4 ends with a hair strand catch 42. The hair strand catch 42 is closed by two catch inlet members 43. The catch inlet members 43 are made of an elastic material. The elasticity of the catch inlet members 43 is designed such that a grasped strand of hair can be effortlessly introduced through the catch inlet members 43, which elastically adjust during this process, into the hair strand catch 42. The hair strand catch 42 is used to guide a strand of hair, which during operation of the hair shaping device is successively pulled in through the hair strand catch 42. This applies regardless of whether the hair shaping device 1.5 is used to curl a strand of hair or, in the case where the device is also configured with a straightening functionality, to straighten hair.

Figure 11:
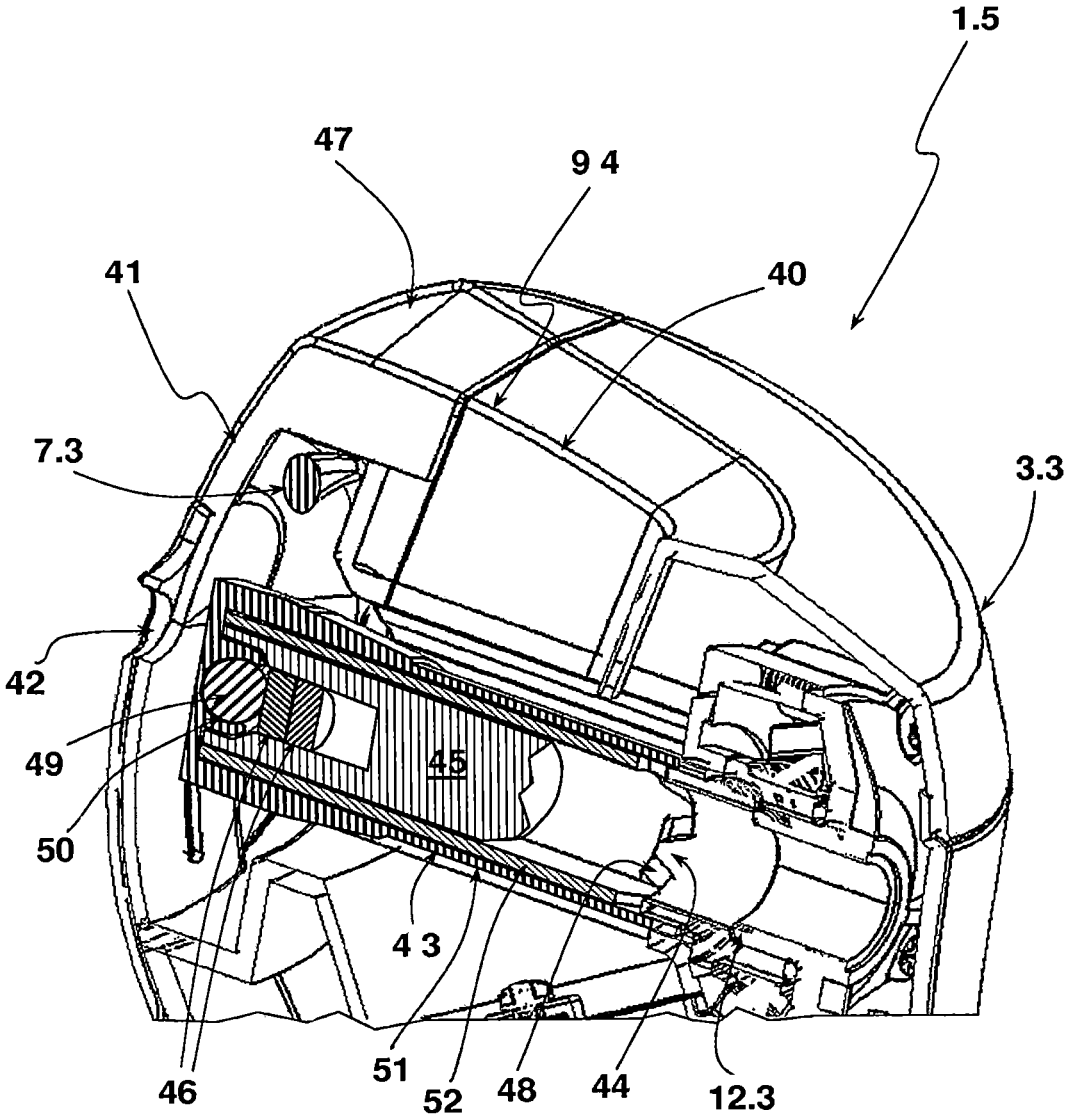
FIG. 11 shows a partial longitudinal section through the hair shaping device from FIG. 10.

FIG. 11 shows a partial longitudinal section to provide a look inside the hair shaping device 1.5 from FIG. 10. The electric motor of the hair shaping device 1.5 is seated within the housing 3.3 adjacent to the head-side termination of the housing 3.3. The drive motor is identified by reference numeral 11.2 in this figure. The electric motor 11.2 comprises a drive shaft 12.3, which carries peripheral teeth 44 on the end thereof pointing away from the head-side end of the hair shaping device 1.5. The drive shaft 12.3 is designed in the manner of a sleeve in this region. The drive shaft continues with a straight shank 45, of which only the front section is shown in this figure. The connection to the drive shaft 12.3 is not shown so as not to obstruct a look into the teeth 44 located behind the straight shank 45. Two magnets 46 are held at the end of the straight shank 45. The magnets 46 serve as the first member of a magnetic coupling. The straight shank 45 is driven together with the drive shaft 12.3 and, together with the same, forms one unit.

In the hair shaping device 1.5, the front housing part 47 (the housing part that includes, among other things, the section 41 of the insertion slot 9.4) can be removed from the remaining housing. This housing part 47 is held on the other housing part by a detent mechanism, which is not shown in the figures. The detachability of the housing part 47 is provided so as to detach the winding core 4.3, which at the end pointing to the housing part 47 has the entraining element 7.3 integrally formed thereon, from the drive shaft 12.3 and replace it with another winding core, such as a winding core having a different diameter of the winding core. Due to the sectional illustration, the entraining element 7.3 is shown only with a section of the entraining element hook thereof in FIG. 11. At the end pointing to the drive shaft 12.3, the winding core 4.3 carries teeth 48 that are complementary to the teeth 44, so that a rotational movement of the drive shaft 12.3 causes the winding core 4.3, and thus the entraining element 7.3. to rotate. A metal ball 49, which is held in a ball cage 50, is accommodated in the component composed of the cylindrical winding core 4.3 and the entraining element 7.3. The ball 49 is made either of a ferromagnetic material or designed as a magnet itself. In the latter case, the polarity is complementary to the polarity of the magnets 46, so that the two parts attract one another. The magnets 46 are disposed to generate a magnetic field, which acts on the ball 49 so that this ball is attracted by the end face of the front magnet 46 pointing away from the drive shaft 12.3. As a result, the magnets 46 and the ball 49 provide a magnetic coupling, the ball 49 cooperating therewith and held in a form-locked manner in the ball cage 50 in the longitudinal axial direction. Due to the immediate proximity of the entraining element 7.3 and the hair strand catch 42, almost no forces act in the pull-off direction of the winding core 4.3 from the straight shank 45 of the drive shaft 12.3 when a strand of hair is pulled in the entraining element 7.3 so as to wind the strand onto the winding core 4.3. Thus, forces do not have to be designed to be excessively high to hold the component composed of the winding core 4.3 and the entraining element 7.3 on the straight shank 45.

In this depicted embodiment, winding core 4.3 comprises an outer cylinder body 51 made of plastic material, the entraining element-side termination of which carries the ball cage 50 or the same is formed in this component. The teeth 48 are part of an inner sleeve 52 held within the outer sleeve 51. The inner sleeve 52 may be a metal component, for example made of an aluminum alloy.

The above-described concept of a replaceability of the winding core, along with the entraining element, can likewise be applied to a hair shaping device in which the winding core is designed to be isolated from rotation with respect to the entraining element, as is described in the embodiment from FIG. 6.

The invention was described above based on selected embodiments. A person skilled in the art will derive further embodiments for implementing the invention without departing from the scope of the present claims. While a number of exemplary aspects and embodiments have been discussed, those of skill in the art will recognize certain modifications, permutations, additions and sub-combinations are possible. It is intended that the following appended claims are interpreted to include all such modifications, permutations, additions and sub-combinations, as they are within the true spirit and scope of the claims. Each embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and sub-combinations possible of the group are intended to be individually included in the disclosure.

In general, the terms and phrases used herein have their art-recognized meaning, which can be found by reference to standard texts, journal references and contexts known to those skilled in the art. The above definitions are provided to clarify their specific use in the context of the invention.

The invention claimed is:

1. A hair shaping device for both curling and straightening hair, comprising:

a winding core for winding a strand of hair having a longitudinal axis;

an entraining element configured to be rotatably driven around an axis of rotation which corresponds to the longitudinal axis of the winding core, the entraining element configured to grasp a strand of hair and wind the strand of hair around the winding core;

a housing that encloses the winding core, wherein a radial distance of the inside of the housing from the winding core defines and delimits a winding space around the winding core, the housing comprising a slot extending in the direction of the longitudinal axis of the winding core for inserting a strand of hair to be shaped into the winding space; and at least two shaping bodies disposed in the winding space at a radial distance from the winding core, the shaping bodies displaceably mounted on protrusions formed on the inside of the housing, each shaping body having a longitudinal extent which follows the slot, the sides of the shaping bodies facing one another each comprising a shaping surface at least where the shaping bodies are mutually opposing, the opposing shaping surfaces configured to be moved toward one another and held there in relation to one another such that a strand of hair can be pulled between the shaping surfaces and make contact with the shaping surfaces when the hair shaping device is used for straightening;

wherein the entraining element is disposed within the winding space, and the shaping surfaces of the shaping bodies are disposed within the winding space at a distance from the slot of the housing;

wherein the slot is configured to receive a section of a strand of hair to be shaped into the winding space, the slot extends into the housing on a side for pulling in the strand of hair and delimits the winding space on the side for pulling in the strand of hair;

wherein a strand of hair inserted into the slot is grasped by the entraining element rotating within the winding space when in operation for curling;

wherein the shaping bodies are configured to be moved away from one another such that a strand of hair inserted into the slot is not pressed therebetween when the hair shaping device is used for curling; and wherein the housing comprises a warm air flow inlet for supplying heat via a warm air flow to a strand of hair located in the winding space between the winding core and the housing to form a curl or to straighten the strand of hair.

2. The hair shaping device of claim 1, wherein the entraining element is in one end of the housing, and an end of the slot located opposite the entraining element ends before termination of the housing.

3. The hair shaping device of claim 1, wherein the entraining element is in one end of the housing, and the winding space is closed on a side of the housing located opposite the entraining element.

4. The hair shaping device of claim 1, wherein the winding core is formed by a sleeve which is mounted on a shaft and isolated from rotation of the shaft.

5. The hair shaping device of claim 4, wherein the sleeve comprises two peripheral delimiting flanges that are spaced apart from one another by the winding space along the longitudinal axis of the winding core.

6. The hair shaping device of claim 4, wherein the entraining element is connected in a torque-locked manner to the shaft on which the winding core is mounted, and the shaft is driven by an electric motor.

7. The hair shaping device of claim 1, further comprising a wall separating the winding space between the winding core and the housing into two winding areas, wherein the wall projects from the inside of the housing but does not contact the winding core, such that the distance between the wall and the winding core allows for a strand of hair to be shaped to be guided therethrough.

8. The hair shaping device of claim 1, further comprising one or more hold-down devices projecting from the inside of the housing toward the winding core.

9. The hair shaping device of claim 1, wherein the entraining element has a free run across a certain rotation angle range with respect to a drive element driving the entraining element.

10. The hair shaping device of claim 9, wherein the entraining element is connected to the drive element via an interposed restoring member, the restoring member configured to return the entraining element to a predefined starting position in relation to the drive element after having been driven.

11. The hair shaping of claim 9, wherein the drive element is a driving cam engaging in a clearance of the entraining element.

12. The hair shaping device of claim 1, wherein the shaping bodies extend radially outward from the winding space at least into the slot.

13. The hair shaping device of claim 1, wherein the shaping bodies comprise guide surfaces adjacent to the shaping surfaces, the guide surfaces having an increasing distance between one another moving out from the shaping surfaces.

14. The hair shaping device of claim 1, wherein the shaping bodies are displaceable relative to one another transversely to the longitudinal axis of the slot.

15. The hair shaping device of claim 14, wherein at least one shaping body is acted upon by a spring, a force of the spring configured to hold the at least one shaping body in a closed position in relation to the other shaping body.

16. The hair shaping device of claim 1, wherein an end of the slot facing the side of the housing for pulling in a strand of hair is configured as a hair strand catch delimited by at least one elastic catch inlet member.

17. The hair shaping device of claim 1, wherein the winding core and the entraining element form a single structural unit, the housing enclosing the winding space can be at least partially opened, and the single structural unit comprising the winding core and the entraining element is detachably connected in a torque-locked manner to a drive shaft of a drive motor.

18. The hair shaping device of claim 1, wherein the hair shaping device is an attachment for a device supplying the warm air flow.

19. The hair shaping device of claim 1, further comprising a fan configured to provide the warm air flow, the fan accommodated in a handle of the hair shaping device.

* * * * *